US008978169B2

(12) United States Patent
Berglund et al.

(10) Patent No.: US 8,978,169 B2
(45) **Date of Patent: *Mar. 17, 2015**

(54) PROTECTIVE CLOTHING ENSEMBLE WITH TWO-STAGE EVAPORATIVE COOLING

(71) Applicants: Larry Berglund, Lebanon, CT (US); Reed Hoyt, Framingham, MA (US)

(72) Inventors: Larry Berglund, Lebanon, CT (US); Reed Hoyt, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/782,132

(22) Filed: Mar. 1, 2013

(65) Prior Publication Data

US 2013/0174335 A1 Jul. 11, 2013

Related U.S. Application Data

(63) Continuation of application No. 13/481,292, filed on May 25, 2012, now Pat. No. 8,495,767, which is a continuation-in-part of application No. PCT/US2011/030478, filed on Mar. 30, 2011.

(60) Provisional application No. 61/319,070, filed on Mar. 30, 2010.

(51) Int. Cl.

| | |
|---|---|
| ***A41D 13/00*** | (2006.01) |
| ***A62B 17/00*** | (2006.01) |
| ***A41D 13/005*** | (2006.01) |
| *G21F 3/025* | (2006.01) |

(52) U.S. Cl.

CPC ..... *A62B 17/00* (2013.01); *A41D 13/0053* (2013.01); *A62B 17/005* (2013.01); *A41D 2400/60* (2013.01); *A62B 17/006* (2013.01); *G21F 3/025* (2013.01); *Y10S 2/01* (2013.01); *Y10S 2/05* (2013.01)

USPC ..... 2/457; 2/458; 2/69; 2/84; 2/DIG. 1; 2/DIG. 5; 128/202.12; 128/202.19; 36/43; 36/147; 62/259.3; 62/390; 62/391

(58) Field of Classification Search

USPC ..... 2/458, 69, 115, 456, 457, 102, 81, 93, 2/97, 272, 275; 128/202.19, 202.11; 36/43, 147; 62/259.3, 390, 391

See application file for complete search history.

(56) References Cited

U.S. PATENT DOCUMENTS

| | | | |
|---|---|---|---|
| 4,706,672 | A | 11/1987 | Jones |
| 5,111,668 | A | 5/1992 | Parrish et al. |
| 5,113,666 | A | 5/1992 | Parrish et al. |
| 6,125,645 | A | 10/2000 | Hom |
| 6,257,011 | B1 | 7/2001 | Siman-Tov et al. |
| 6,263,511 | B1 | 7/2001 | Moretti |
| 6,276,155 | B2 | 8/2001 | Siman-Tov et al. |
| 6,295,648 | B2 | 10/2001 | Siman-Tov et al. |

(Continued)

FOREIGN PATENT DOCUMENTS

| | | |
|---|---|---|
| JP | 07-003508 | 1/1995 |

*Primary Examiner* — Danny Worrell
*Assistant Examiner* — Khaled Annis
(74) *Attorney, Agent, or Firm* — Elizabeth Arwine; William Eshelman

(57) ABSTRACT

A hazardous materials protective garment may use a two-stage evaporative cooling process to ease heat strain on the wearer of the garment. The garment may include an impermeable inner layer and a wicking outer layer. One or more reservoirs may be disposed interior to the inner layer for collecting condensed and/or unevaporated sweat. One or more pumps may move the sweat to the exterior of the impermeable layer for distribution in the wicking layer and evaporation from the garment.

31 Claims, 9 Drawing Sheets

(56) References Cited

U.S. PATENT DOCUMENTS

| | | | |
|---|---|---|---|
| 7,043,766 | B1 | 5/2006 | Foreman et al. |
| 7,120,938 | B2 | 10/2006 | Ichigaya |
| 7,730,557 | B1 | 6/2010 | Courtney et al. |
| 7,866,177 | B2 | 1/2011 | Selm et al. |
| 2004/0237178 | A1 | 12/2004 | Landeros |
| 2005/0010996 | A1 | 1/2005 | Steinert |
| 2005/0011517 | A1 | 1/2005 | Steinert |
| 2005/0246826 | A1 | 11/2005 | McCarter et al. |
| 2010/0011491 | A1 | 1/2010 | Goldmann et al. |
| 2010/0031428 | A1 | 2/2010 | Paull |

PROTECTIVE CLOTHING ENSEMBLE WITH TWO-STAGE EVAPORATIVE COOLING

CROSS-REFERENCE TO RELATED APPLICATIONS

The present application is a continuation of and claims the benefit of priority under 35 U.S.C. 120 to U.S. patent application Ser. No. 13/481,292 filed on May 25, 2012, which is a continuation-in-part of and claims the benefit of priority under 35 U.S.C. 120 to International Application Number PCT/US11/30478 filed on Mar. 30, 2011, which claims priority to U.S. provisional patent application Ser. No. 61/319,070 filed on Mar. 30, 2010, all of which are expressly incorporated by reference herein.

STATEMENT OF GOVERNMENT INTEREST

The invention described herein may be manufactured, used and licensed by or for the United States Government.

BACKGROUND OF THE INVENTION

Warriors, first-responders, and industrial workers are examples of personnel who may perform physically-demanding tasks with high rates of metabolic energy expenditures and metabolic heat production. These personnel may be equipped with protective clothing, for example, chemical, biological, radiological, nuclear, and explosive protective clothing, combat clothing, or other individual protective clothing ensembles. Normal mechanisms of dissipating excess metabolic heat, for example, through evaporative cooling in warm and hot environments, may be compromised by the insulation and resistance to water vapor permeation of known protective ensembles. Known protective clothing may increase metabolic heat production due to the metabolic cost of carrying and using the ensemble, and compromise metabolic heat loss by impeding evaporative cooling and dry heat dissipation through conduction, convection, and radiative heat loss. Reducing the thermal burden imposed by protective ensembles has long been, and continues to be, an important need for designers, manufacturers, and users of protective clothing.

Active cooling systems for protective ensembles are known. Active microclimate cooling systems may be thermoelectric systems, or compressor-based systems with a coolant that is circulated in tight-fitting vests, or, perhaps, blower systems that pass filtered outside air over the body and exhaust the air outside the protective suit. Compressor-based or thermoelectric systems may be power hungry, may be expensive, and may be heavy in weight. Air blower systems may be lighter in weight and more comfortable than compressor-based systems, but may be noisy, may have relatively high heat signatures (i.e., may be detected by infrared sensors), may require intake filtering of the air, and may have variable performance, depending on air inlet temperature and humidity. Air blower systems may be impractical in a chemically, biologically, and/or radiologically contaminated environment where filtering a large volume of inlet air may require a large filter capacity.

A long-felt but unsolved need has existed, and continues to exist, for lighter weight, more energy-efficient methods and apparatus to help reduce the thermal load of personnel equipped with protective clothing ensembles.

SUMMARY OF THE INVENTION

One aspect of the invention is a protective garment for an animate being. The protective garment may include an impermeable inner layer. A reservoir may be disposed interior to the inner layer, for collecting sweat from the animate being. The garment may include a pump for moving the sweat from the reservoir to a location external to the inner layer. The animate being may be a human.

The sweat collected in the reservoir may be unevaporated liquid sweat, and/or liquid sweat that has exuded or been excreted from the animate being, evaporated, and condensed on the inner layer. The pump may be disposed interior to the inner layer.

The garment may include a distribution system located external to the inner layer, for distributing the sweat on an exterior of the garment. Inlet tubing may have one end in fluid communication with the reservoir and another end connected to an inlet of the pump. Outlet tubing may have one end connected to an outlet of the pump and another end that passes through the inner layer. The outlet tubing may be operatively connected to the distribution system.

The garment may include an external reservoir disposed exterior to the inner layer and fluidly connected to the internal reservoir. The external reservoir may supply water to the internal reservoir for distribution inside or outside of the inner layer.

The distribution system may include wicking material and/or at least one fluid conduit. The distribution system may include at least one fluid conduit in fluid communication with the outlet tubing, and wicking material adjacent to at least one fluid conduit. The wicking material may be an external layer of the garment.

Another aspect of the invention is a method. The method may include providing an animate being with a protective garment and collecting sweat from the animate being in a reservoir. The method may include pumping the sweat to an exterior of the garment. The collected sweat may include sweat that has condensed on an inner layer of the garment. The collected sweat may include unevaporated sweat.

The method may include, after pumping, distributing the sweat on an exterior of the garment. The method may include, after distributing, evaporating the sweat from the exterior of the garment.

Water from a reservoir that is external to the inner layer of the garment may also be collected in the reservoir that collects sweat. One or both of water and sweat may be pumped to the exterior of the garment or distributed between the inner layer and the animate being.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIGS. 8A-B, 9A-B, and 10A-B were generated using thermal-physiological modeling based on principles of physics and physiology.

DETAILED DESCRIPTION

A two-stage evaporative cooling process and protective overgarment may reduce overheating and heat illness experienced by those who wear protective garments such as hazardous material suits. The cooling process and overgarment may be suitable for animate beings, in particular, humans. A first stage of evaporative cooling may include evaporation of sweat from the skin of a human, or evaporating sweat from an undergarment that is worn next to the skin. The undergarment may have multiple layers. The sweat vapor may condense on an interior surface of an inner, impermeable layer of the loose-fitting protective garment.

As used herein, "impermeable layer" means a layer of a garment that is at least impermeable to water vapor and water. Preferably, the impermeable layer may also be impermeable to a range of chemical, biological, and other types of hazards. Different chemical, biological, or other types of hazards may require the selection of varying materials for the impermeable layer. Examples of materials for impermeable layers of protective garments are well-known in the field of hazardous materials protection. Such materials may include PTFE (polytetrafluoroethylene, e.g., TEFLON®), Dupont™ Tychem® TK, impermeable Dupont™ Nomex®, Gore® CHEMPACK® Ultra Barrier, or other impermeable materials, such as cotton or nylon fabric coated with polyvinyl chloride (PVC), polyurethane (PU), or rubber.

A second stage of evaporative cooling may occur on the exterior surface of the protective garment, exterior of the impermeable layer. The second stage of evaporative cooling may help dissipate the heat of condensation generated on the interior surface of the impermeable layer. The second stage of evaporative cooling may include pumping condensed sweat from inside the garment to the exterior of the garment and then distributing the condensed sweat on the exterior surface of the garment for re-evaporation. The second stage of evaporative cooling may include pumping unevaporated sweat from inside the garment to the exterior of the garment and then distributing the unevaporated sweat on the exterior surface of the garment for evaporation. In some embodiments, the second stage may include pumping water from inside the garment to the exterior of the garment and then distributing the water on the exterior surface of the garment for re-evaporation.

Figure 1:
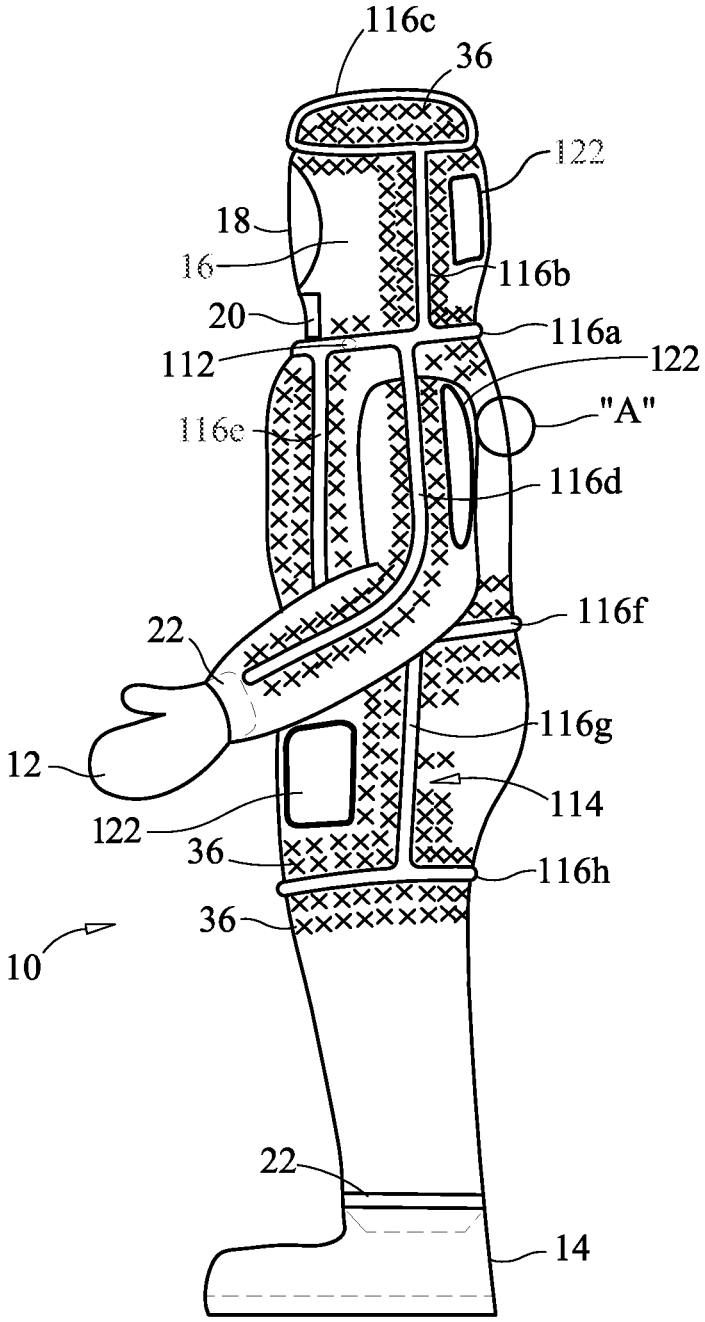
FIG. 1 is a schematic side view of one embodiment of a protective garment.

FIG. 1 is a side view of one embodiment of a protective garment 10. Protective garment 10 may be a unitary garment, or may have separate top (jacket) and bottom (pants) portions. Protective garment 10 may include removable gloves 12. Or, gloves 12 may be integral with garment 10. Protective garment 10 may include removable shoes or boots 14. Or, shoes or boots 14 may be integral with garment 10. Apparatus and methods for seals 22 around removable boots 14 and removable gloves 12 are known in the art. The degree of integrity of the sealing method that is required for boots 14 and/or gloves 12 depends on the nature or level of the chemical, biological, or other threat. As is known in the art, the composition of garment 10 may be different for different areas of garment 10. For example, the composition of boots 14 and/or gloves 12 may differ from the composition of the remainder of garment 10, particularly if boots 14 and/or gloves 12 are separately removable from the remainder of garment 10.

In the embodiment of FIG. 1, garment 10 includes an integral head covering 16. Head covering 16 may include a transparent viewing portion 18. Respiration may be variously accomplished via a backpack re-breather, a self-contained breathing apparatus, or a tethered system where air is supplied via a hose (not shown), as in the U.S. Army's Self-Contained Toxic Environment Protective Outfit (STEPO). Excess pressure may be released via one or more one-way exhaust vents 20. Or, in lieu of integral head covering 16, a gas mask with or without other head covering may be used. In some embodiments, water in expired breath may be condensed, captured and re-evaporated.

Garment 10 may be an overgarment, that is, the outermost component of a clothing ensemble. As such, garment 10 may be sized to be generally loose-fitting on the wearer of the garment, for example, to allow freedom of movement or to provide ample space for undergarments. Undergarments are not required with garment 10, but may be used. For example, a T-shirt and shorts may be worn under garment 10. For military use, an Army Combat Uniform (ACU) worn with undershirt and underpants may be worn with or without armor under garment 10. Other types of garments may be worn under garment 10. In general, garment 10 may not be pre-tensioned against the wearer, in contrast to elasticized, tight-fitting garments. But, in some embodiments of garment 10, selected pre-tensioning may be used for protective purposes, for example, elastic sleeve cuffs, leg cuffs, neck band, etc.

Figure 2:
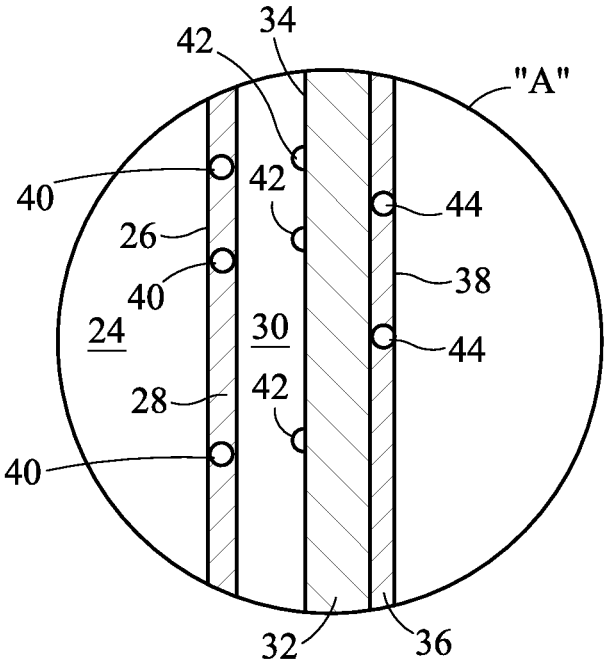
FIG. 2 is an enlarged, schematic, sectional view of portion "A" of FIG. 1.

FIG. 2 is an enlarged, schematic, sectional view of portion "A" of FIG. 1. In FIG. 2, a human 24 has an outer skin 26. Optionally, an undergarment 28 may be juxtaposed with skin 26. An air gap or space 30 may be adjacent undergarment 28, or, if undergarment 28 is not present, air gap 30 may be adjacent skin 26. Garment 10 may be disposed adjacent air gap 30. The width of air gap 30 may vary on different areas of human 24 as human 24 moves around and/or changes position. At some times, in some areas of the human's body that are flexed (e.g., elbows, knees) or are supporting the weight of garment 10 (for example, shoulders), the width of air gap 30 may approach or become zero.

Garment 10 may include an impermeable, inner layer 32 having an inner surface 34 contiguous with air gap 30. Garment 10 may include a moisture wicking, outer layer 36 disposed opposite impermeable inner layer 32. Garment 10 may have an exterior surface 38. Wicking outer layer 36 may be a wicking fabric, such as polyester, for example. Wicking fabrics may be non-absorbent. Wicking fabrics may include a system of fibers that work like capillaries to carry water. Wicking fabrics may have surface texture, for example, puckers in the fabric may increase the surface area and enhance evaporation. Wicking outer layer 36 may also be a surface treatment, for example, a liquid or spray that may be applied to an outer surface of impermeable inner layer 32. The surface treatment may be a surfactant (e.g., Woolite®) that decreases water surface tension and promotes wetting of fabric.

In some embodiments of the invention, a semi-impermeable layer may be substituted for impermeable layer 32. The semi-impermeable layer may be at least impermeable to liquid water, but semi-impermeable to water vapor, such as a GORE-TEX® type of material.

Human 24 may excrete or exude liquid sweat 40 from skin 26. If no undergarment 28 is present, liquid sweat 40 may evaporate directly from skin 26, pass through air space 30 as sweat vapor, and condense on inner surface 34 as condensed sweat 42. If undergarment 28 is present, liquid sweat 40 may pass through undergarment 28, evaporate from undergarment 28, pass through air space 30 as sweat vapor, and condense on inner surface 34 as re-condensed liquid sweat 42. In either case, skin 26 may be directly or indirectly cooled by evaporation of liquid sweat 40.

As will be described in more detail below, condensed sweat 42 may be collected and transported to wicking outer layer 36. In addition or alternatively, liquid sweat 40 that may not have evaporated may be collected and transported through impermeable inner layer 32 to wicking outer layer 36. On or in wicking outer layer 36, the transported sweat 44 may evaporate from external surface 38 of garment 10. Evaporation of transported sweat 44 from external surface 38 may cool wicking outer layer 36, thereby indirectly cooling impermeable inner layer 32, air space 30, and human 24. It should be noted that, in some embodiments of garment 10, wicking outer layer 36 may be included only in selected areas of garment 10. For example, wicking outer layer 36 may be included on areas of garment 10 that are near to areas of human 24 which exhibit the greatest increases in sweat rate when the core temperature of human 24 increases. Such areas of higher sweat rates in human 24 may be, for example, the head, torso, arms, and upper legs.

Figure 3:
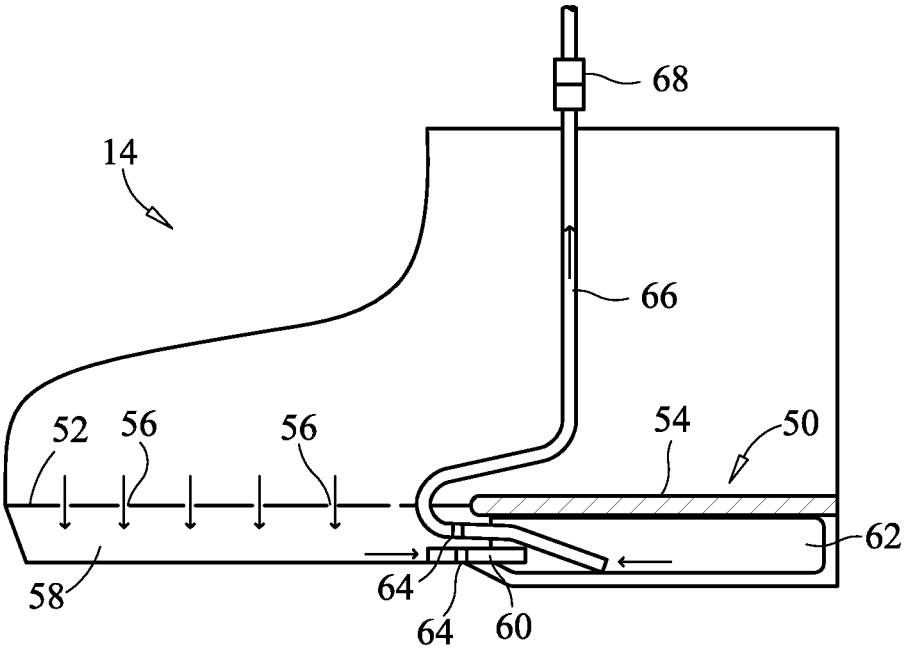
FIG. 3 is a schematic, cutaway, side view of one embodiment of a boot or shoe having a pump.

FIG. 3 is a schematic, cutaway, side view of one embodiment of a boot 14. Boot 14 may be made integral with garment 10 or may be removable separately from the remainder of garment 10. Boot 14 may include a pump 50, a forward insole 52, and a rear insole 54. Forward insole 52 and rear insole 54 may include pores 56. Condensed sweat 42 from inner surface 34 of garment 10 and/or unevaporated sweat 40 may accumulate in boot 14 and pass through pores 56 into a bottom area 58 of boot 14. From bottom area 58, the accumulated sweat may enter inlet tubing 60 and thence reservoir 62. A check or one-way valve 64 may be disposed in inlet tubing 60 to prevent flow from reservoir 62 into bottom area 58. Reservoir 62 may be, for example, an elastic or flexible bladder. Rear insole 54 may be, for example, an elastic membrane.

The intermittent force of the heel of human 24 on rear insole 54 and reservoir 62 may pump collected sweat from reservoir 62 through an outlet tubing 66 and, ultimately, through impermeable inner layer 32 to wicking outer layer 36. A check valve or one-way valve 64 may be disposed in outlet tubing 66 to prevent backflow into reservoir 62. A quick-disconnect coupling 68 may be included in outlet tubing 66, particularly if boot 14 is a removable type boot.

Figure 4:
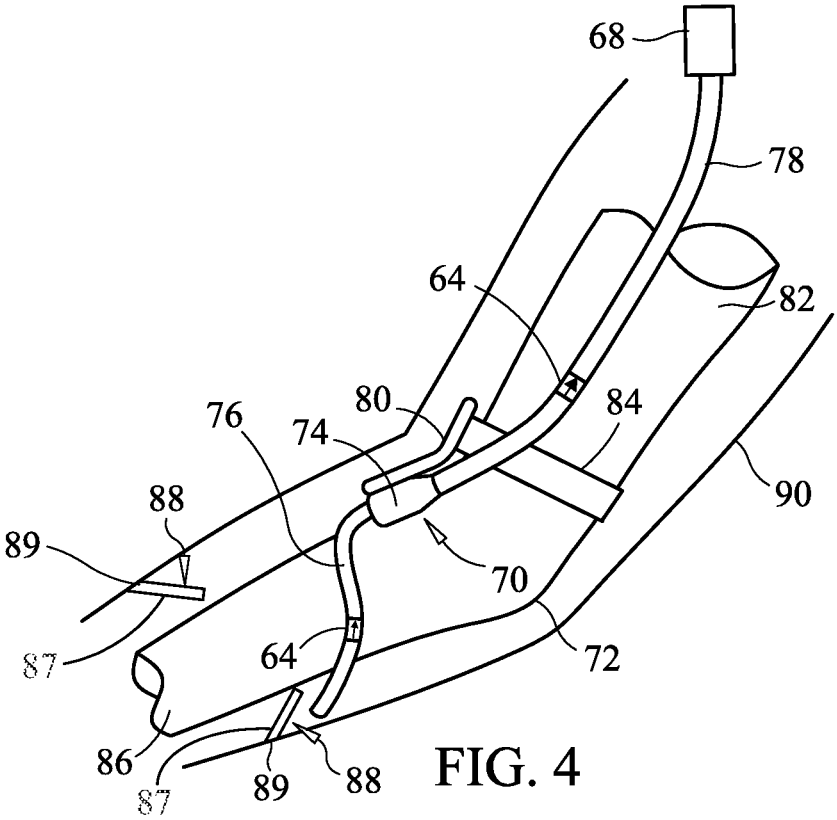
FIG. 4 is a schematic, cutaway, side view of one embodiment of a pump located near an elbow of a human.

FIG. 4 is a schematic, cutaway, side view of one embodiment of a pump 70 located near an elbow 72 of human 24. Pump 70 may include an elastic or flexible bladder 74 for containing unevaporated and/or condensed sweat. Bladder 74 may be connected to inlet tubing 76 and outlet tubing 78. A flexible shaft 80 may have one end fixed to upper arm 82 with adjustable strap 84 and another end that extends toward lower arm 86 and bears on bladder 74. Inner surface 34 of impermeable layer 32 may include a reservoir 88 for collecting unevaporated sweat and/or sweat that has condensed on inner surface 34. Reservoir 88 may be in the form of, for example, a flexible, semi-rigid, or rigid gutter 87 with one end 89 fixed to surface 34. Gutter 87 may extend circumferentially (partially or completely) around the inner surface 34 of a sleeve 90 of garment 10. Gutter 87 may be made of, for example, a plastic material covered with a waterproof fabric.

Movement of elbow joint 72 may cause pump 70 to transport accumulated sweat from reservoir 88 via inlet tubing 76 to outlet tubing 78 and, ultimately, through impermeable inner layer 32 to wicking outer layer 36. Check valves 64 may be disposed in inlet tubing 76 and outlet tubing 78. A quick-disconnect coupling 68 may be included in outlet tubing 78 to facilitate set-up of garment 10 and to provide an option to use or not use pump 70.

Figure 5:
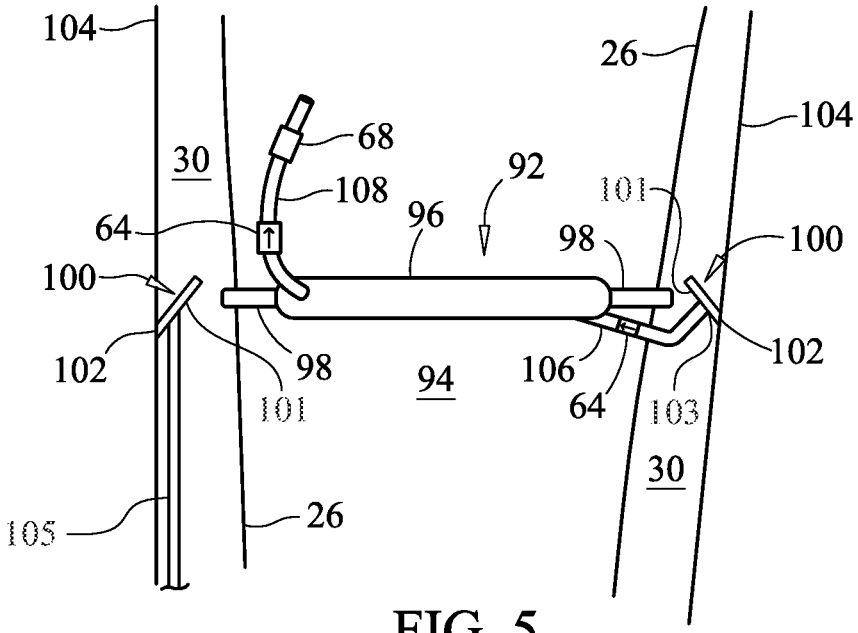
FIG. 5 is a schematic front view of one embodiment of a pump located on a torso of a human.

FIG. 5 is a schematic front view of one embodiment of a pump 92 located on a torso 94 of human 24. Pump 92 may be located on the lower chest so that inspiration movements of human 24 may cause elastic bladder 96 to decrease in volume. Bladder 96 may be attached to human 24 using, for example, an adjustable strap 98 that may extend around torso 94. A reservoir 100 may be disposed on an inner surface 34 of impermeable layer 32. Reservoir 100 may be in the form of, for example, a flexible, semi-rigid, or rigid gutter 101 with one end 102 fixed to surface 34. Gutter 101 may extend circumferentially (partially or completely) around the inner surface 34 of a torso portion 104 of garment 10. Gutter 101 may be made of, for example, a plastic material covered with a waterproof fabric. Inlet tubing 106 may extend from pump 92 to an opening 103 in gutter 101.

Breathing movements of human 24 may cause pump 92 to transport sweat from reservoir 100 through opening 103 and inlet tubing 106 and then to outlet tubing 108 and, ultimately, through impermeable inner layer 32 to wicking outer layer 36. Check valves 64 may be disposed in inlet tubing 106 and outlet tubing 108. A quick-disconnect coupling 68 may be included in outlet tubing 108 to facilitate set-up of garment 10 and to provide an option to use or not use pump 92. In lieu of pump 92, one or more downspouts in the form of tubing 105 (internal to torso portion 104 of garment 10) may carry contents of reservoir 100 to bottom area 58 of boot 14 or to reservoir 62 in boot 14.

As discussed above, pumps 50, 70, and 92 may be powered by the natural movements of human 24 that may occur while performing a task. "Natural body movements" are not movements of human 24 that are consciously and specifically directed to only actuating a pump. One or more of pumps 50, 70, 92 may be used in various combination and numbers. For example, a multiplicity of pumps may be arrayed circumferentially around elbows, knees, waist, shoulder, underarm, hip and other areas such that the action of bending at these locations may result in bladder compression and fluid output, and straightening at these locations may result in bladder re-expansion and fluid intake. Other pumps, such as battery-powered pumps or hand pumps may be used. The sweat may be pumped by the pump or pumps through the outlet tubing and through impermeable inner layer 32 to wicking outer layer 36. From wicking outer layer 36, the sweat may be distributed on external surface 38 of garment 10 and evaporated to thereby cool garment 10.

Figure 6A:
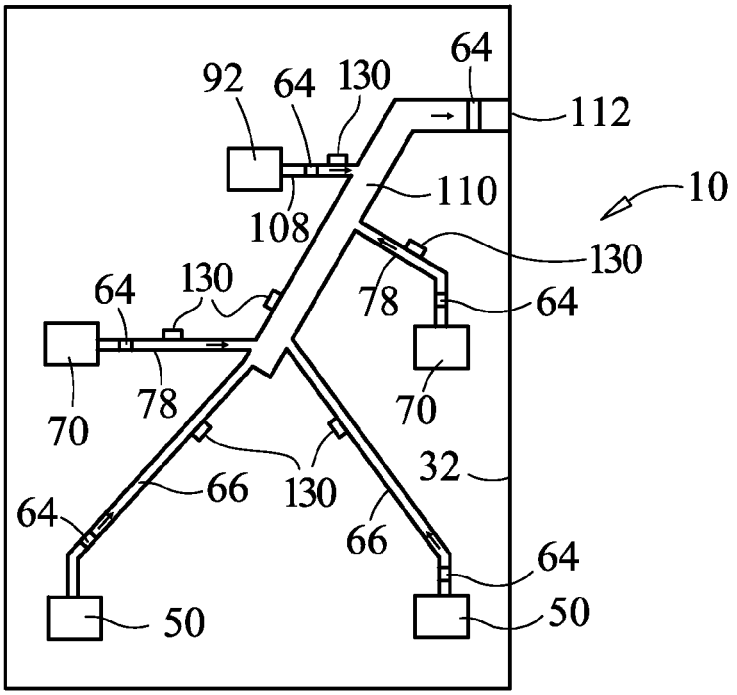
FIGS. 6A and 6B are schematic fluid flow diagrams of a protective garment.
Figure 6B:
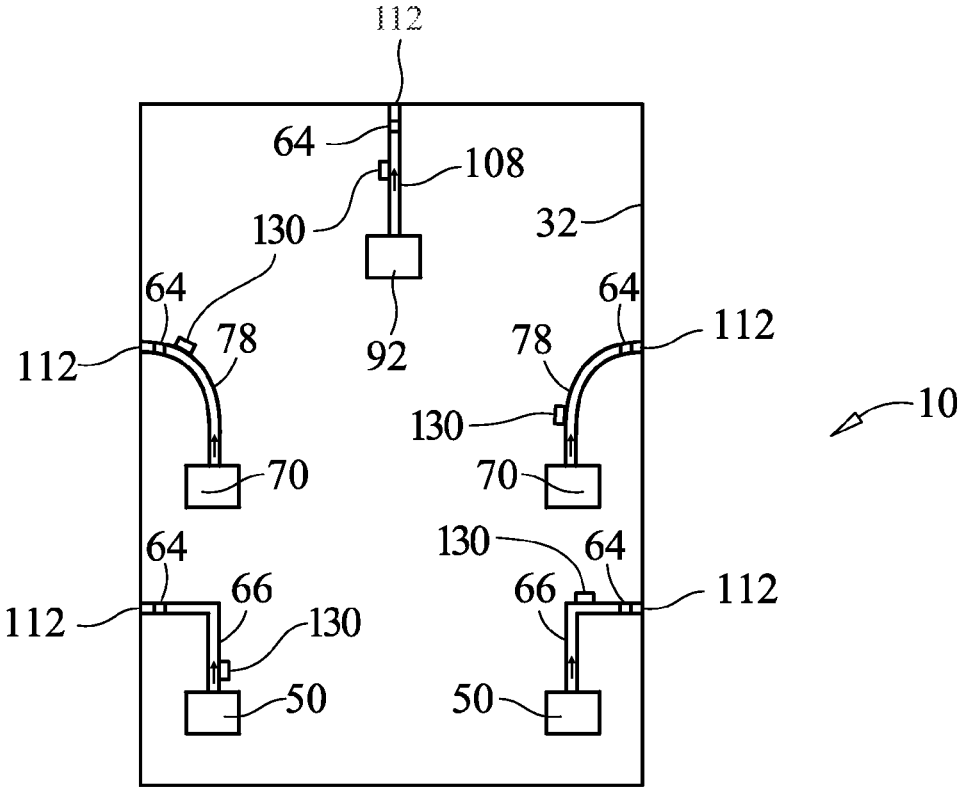

Outlet tubing from each pump, for example, outlet tubing 66, 78 and 108, may be joined together before piercing impermeable layer 32. Or, each outlet tubing may independently pierce impermeable layer 32. FIG. 6A is a schematic flow diagram of a garment 10 having two pumps 50, two pumps 70 and one pump 92. Outlet tubing 66, 66, 78, 78, and 108 from each of the respective pumps may join an outlet header or manifold 110. Header 110 may pierce or pass through impermeable layer 32 at an opening 112. Opening 112 may be sealed around header 110. Check valves 64 may be used to prevent backflow. FIG. 6B is a schematic flow diagram of a garment 10 having two pumps 50, two pumps 70 and one pump 92. Outlet tubing 66, 66, 78, 78, and 108 from each of the respective pumps may independently pass through impermeable layer 32 at multiple openings 112. Openings 112 may be sealed around each outlet tubing. Check valves 64 may be used to prevent backflow. Outlet tubing from the pumps and/or outlet header 110 may be fastened to inner surface 34 of impermeable layer 32. FIGS. 6A and 6B are exemplary only. The number of pumps used may be one or more.

At opening 112 or openings 112, sweat flowing in the outlet tubing or outlet header may flow into a distribution system for distributing the sweat on or in the outer wicking layer 36. FIG. 1 shows a distribution system 114 that may include a plurality of tubes with holes or perforations. The holes may allow the sweat to flow into wicking layer 36. The cross-section of the tubing that forms distribution system 114 may be circular, semi-circular or some other cross-section.

Figure 7A:
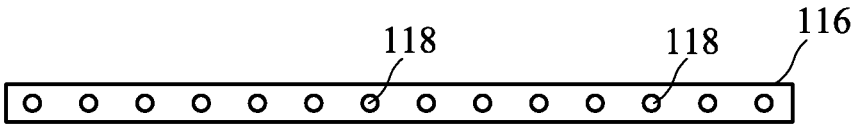
FIGS. 7A and 7B are side and ends views, respectively, of one embodiment of tubing for a distribution system.
Figure 7B:
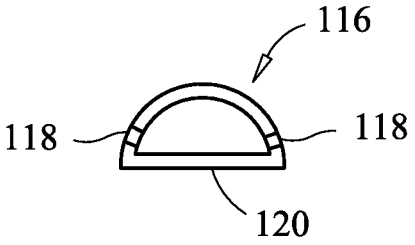

FIGS. 7A and 7B are side and ends views, respectively, of one embodiment of tubing 116 for distribution system 114. Tubing 116 may have a semi-circular cross-section. Tubing 116 may include openings 118 for the passage of liquid sweat from tubing 116 to wicking layer 36. A flat side 120 of tubing 116 may face inward toward human 24. Tubing 116 may be disposed so as to lie on top of wicking layer 36, or be partially or completely embedded in wicking layer 36. Wicking outer layer 36 may also be a surface treatment, for example, a liquid or spray that may be applied to an outer surface of impermeable inner layer 32 thereby enabling the outer surface to wick, spread, and/or distribute water over regions of the outer surface.

In FIG. 1, outlet header 110 (FIG. 6A) may exit layer 32 at opening 112 (shown in dashed line) in the neck area and may fluidly communicate with tubing 116*a* disposed around the bottom of head covering 16. A vertical tubing 116*b* may lead to a tubing 116*c* that may be arranged circularly or circumferentially (partially or completely) around the top of head covering 16. A check valve (not shown) may be included in vertical tubing 116*b* to prevent backflow. A tubing 116*d* may extend from tubing 116*a* down sleeve 90 of garment 10. A tubing 116*e* may extend from tubing 116*a* down torso portion 104 of garment 10 to a waist tubing 116*f*. Waist tubing 116*f* may be arranged circumferentially (partially or completely) around garment 10. Vertical leg tubing 116*g* may extend from waist tubing 116*f* to a circumferential thigh tubing 116*h*. Of course, tubing 116 may be arranged in many different ways on the exterior of garment 10. In addition, garment 10 may include plumbing and valves configured to distribute harvested sweat to hotter surfaces where sweat evaporation may occur most effectively. Toxic environments of microbes, viruses and tiny insects, etc., may require check valves with enhanced sealing features. Such check valves may require higher opening pressures. Higher opening pressures may be supplied by, for example, a piston or pump driven by a battery-operated, electric motor or solenoid.

Wicking layer 36 may receive liquid sweat that may exit openings 118 in the network of tubing 116 that forms distribution system 114. Wicking layer 36 may be present wherever impermeable layer 34 is present, or may be selectively used. In FIG. 1, wicking layer 36 is shown with Xs and may be present in areas near tubing 116*a-h*.

Figure 11:
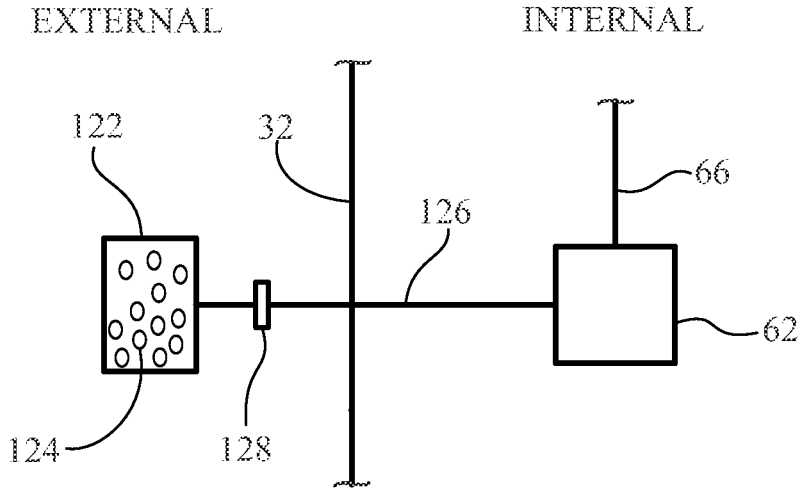
FIG. 11 is a schematic fluid flow diagram of a protective garment that includes an external reservoir.

In some embodiments, garment 10 may include one or more external reservoirs 122 (FIG. 1). In FIG. 1, the locations and sizes of external reservoirs 122 on garment 10 are exemplary only. External reservoir(s) 122 may be of varying capacity. An example of a capacity for external reservoir 122 is 2 liters. External reservoir 122 may be made of any material capable of holding water, for example, plastic or rubber. Reservoir 122 may be flexible or rigid. Reservoir 122 may be attached to the outer surface of garment 10 using, for example, straps or hooks. Reservoir 122 may contain water 124 and may include a fill opening for adding water therein. External reservoir 122 may be disposed exterior to impermeable layer 32 (FIG. 2). External reservoir 122 may be fluidly connected to one or more reservoirs located interior to layer 32, for example, internal reservoirs 62 (FIG. 3), 88 (FIG. 4), or 100 (FIG. 5). FIG. 11 is a schematic fluid flow diagram of garment 10 showing external reservoir 122 connected by tubing 126 to, for example, interior reservoir 62. Flow of water 124 from reservoir 122 may be controlled by, for example, a valve 128.

Thus, one or more of liquid sweat 40 (FIG. 2), condensed sweat 42 (FIG. 2) and water 124 (from reservoir 122) may be pumped from reservoirs internal to layer 32 to outlet tubing. As an example, in FIG. 11, the contents (which may be one or more of liquid sweat 40, condensed sweat 42, and water 124) of interior reservoir 62 may be pumped through outlet tubing 66. In addition to pumping the contents of reservoirs internal to layer 32 to external distribution system 114 (FIG. 1), some or all of the contents of the internal reservoirs may be redistributed in space 30 or on undergarment 28 (FIG. 2) for re-evaporation, which may enhance cooling. Distribution in space 30 or on undergarment 28 may be helpful, for example, when garment 10 is initially donned, when the user is underhydrated, or when the user is not sweating adequately. Inadequate sweating may result from, for example, medications taken by the user of garment 10 to resist the neurotoxic effects of chemical agents.

Redistribution in space 30 or on undergarment 28 may be accomplished by providing one or more fluid exit ports 130 (FIGS. 6A and 6B) in one or more outlet tubes or headers, such as outlet tubes 66, 78, 108 and header 110. Fluid exit ports 130 may include mini or micro nozzles for spraying one or more of liquid sweat 40 (FIG. 2), condensed sweat 42 (FIG. 2) and water 124 onto undergarment 28 and/or in space 30. Ports 130 may be sized such that a portion of the flow through the outlet tubes or headers is redistributed on skin 26 and a portion of the flow is transported to external distribution system 114. Alternatively, separate outlet tubings may be provided from the internal reservoirs for each of: (1) flow to the external distribution system 114; and (2) flow to be redistributed on undergarment 28 and/or in space 30.

The maximum perspiration rate for a human may be about 1.5 liters per hour. The size and capacity of the reservoirs, pumps, bladders, inlet tubing, outlet tubing, outlet headers, and distribution system tubing may be determined, for example, from the maximum perspiration rate and the number and location of pumps used.

Two-stage evaporative cooling garment 10 may be more efficient under certain temperature conditions. For example, garment 10 may be particularly effective for cooling when the ambient (external to garment 10) wet bulb temperature is less than the temperature of impermeable barrier 32, and the temperature of impermeable barrier 32 is less than the temperature of skin 26 (FIG. 2). Even when temperature and humidity conditions may be less than optimal for functioning of garment 10, garment 10 may, nevertheless, provide important advantages. For example, removal of sweat condensate 42 and/or unevaporated sweat 40 from the interior of garment 10 reduces humidity in air space 30, thereby enhancing first-stage evaporation (from skin 26 or undergarment 28). Also, condensed sweat 42 and/or unevaporated sweat 40 that may accumulate inside a garment may cause skin 26 of human 24 to become very soft and perishable. Removal of the sweat helps reduce damage to skin 26.

Figure 9A:
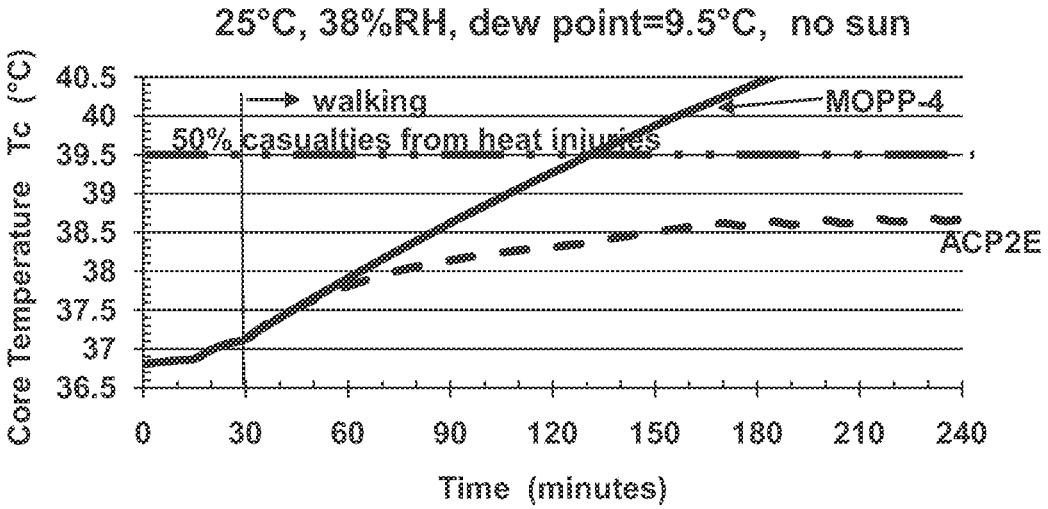
Figure 9B:
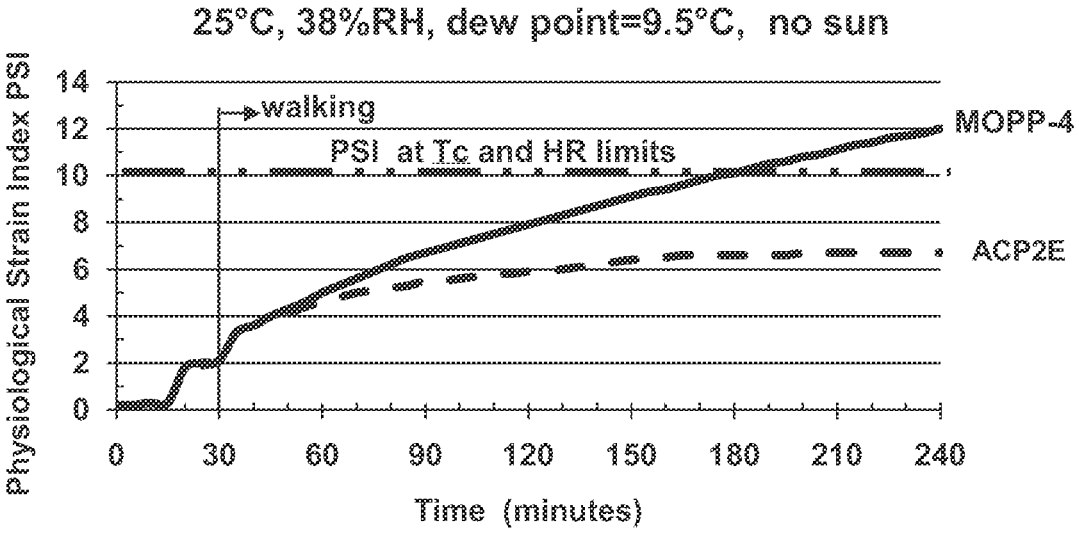
Figure 10A:
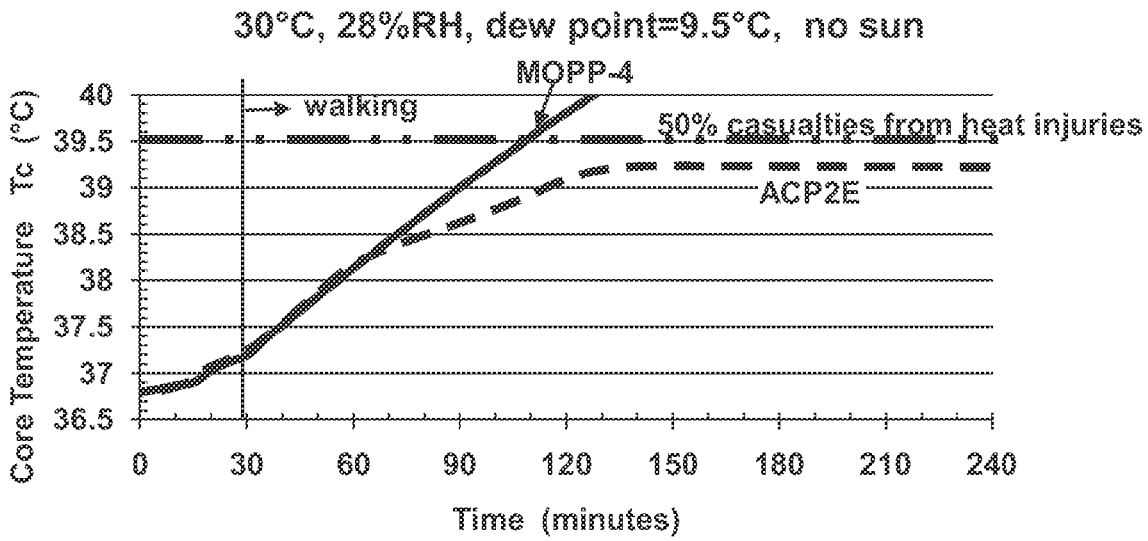
Figure 10B:
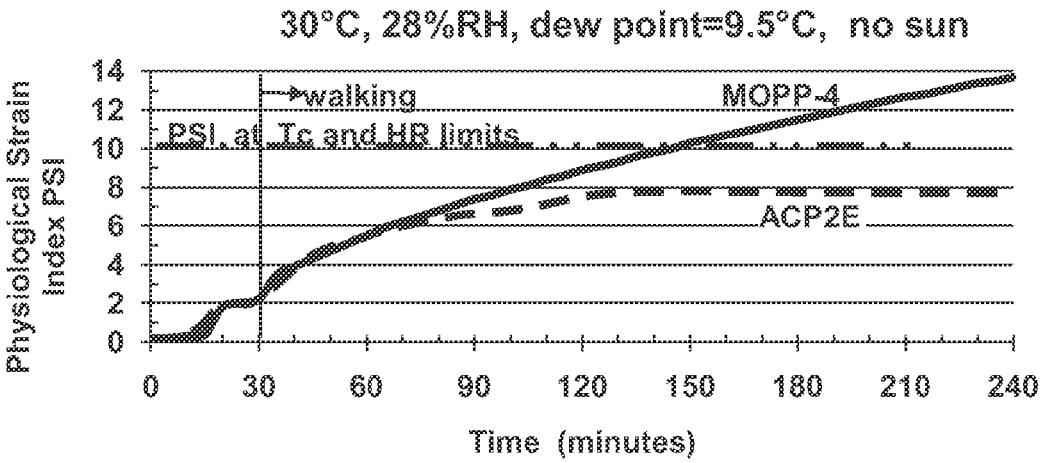

Thermal physiological modeling of two-stage evaporative cooling indicates that physiological heat strain may be reduced. FIGS. 8A-B, 9A-B, and 10A-B are graphs of core temperature (FIGS. 8A, 9A, 10A) and physiological strain index (PSI) (FIGS. 8B, 9B, 10B) versus time, with and without two-stage evaporative cooling. PSI reflects thermal-work strain (i.e., increases in both body temperature and heart rate). The graphs were created from a computer simulation of a human walking while clad in two different ensembles and breathing filtered outside air. One ensemble is a MOPP-4 (Mission Oriented Protective Posture-Level 4) suit without two-stage evaporative cooling. A second ensemble (labeled as ACP2E) is a two-stage evaporative cooling garment 10 with a standard U.S. Army Combat Uniform (ACU) as undergarment 28. In FIGS. 8B, 9B, and 10B, a physiological strain index (PSI) of 10 corresponds to maximum permissible core temperature ($T_C$) and heart rate (HR). In practice, a maximum PSI of 8 is more desirable.

Figure 8A:
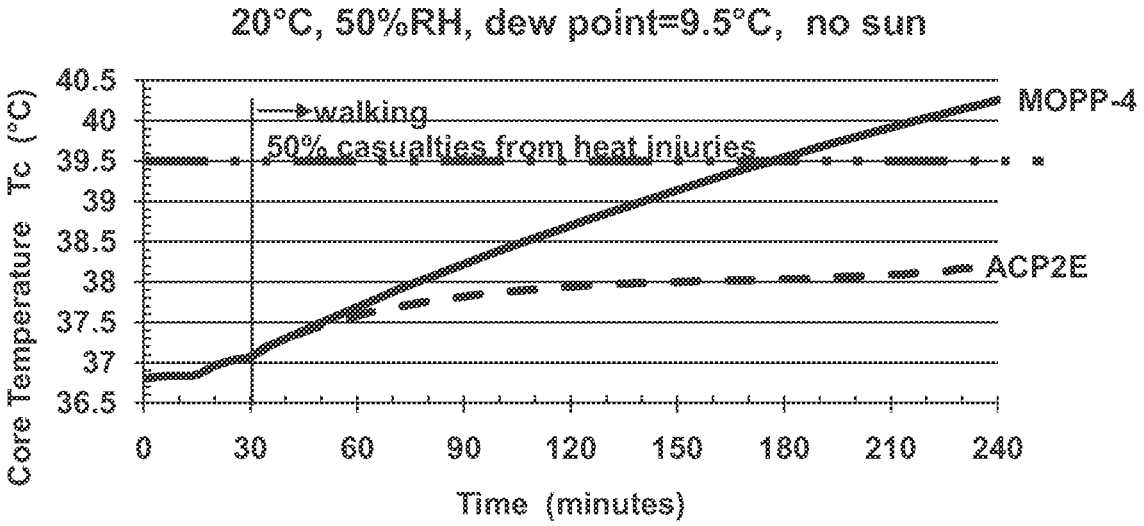
FIGS. 8A-B, 9A-B, and 10A-B are graphs of core temperature (FIGS. 8A, 9A, 10A) and physiological strain index (FIGS. 8B, 9B, 10B) versus time for varying temperature and humidity conditions, with (ACP2E) and without (MOPP-4) two-stage evaporative cooling. The physiological strain index (PSI) is a measure of thermal/work strain expressed on a scale of 1 to 10. Increases in heart rate and body temperature result in increased PSI levels.
Figure 8B:
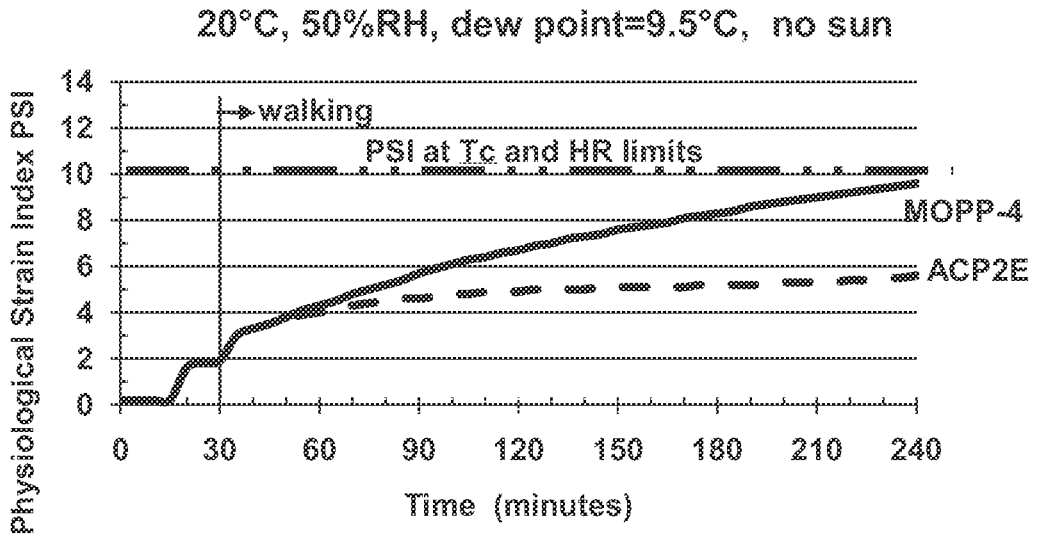

FIGS. 8A-B assume no direct sunlight, ambient temperature of 20 degrees C., relative humidity (RH) of 50%, and a dew point of 9.5 degrees C. FIGS. 9A-B assume no direct sunlight, ambient temperature of 25 degrees C., relative humidity of 38%, and a dew point of 9.5 degrees C. FIGS. 10A-B assume no direct sunlight, ambient temperature of 30 degrees C., relative humidity of 28%, and a dew point of 9.5 degrees C. Compared to the MOPP-4 ensemble, the ACP2E ensemble shows substantially extended safe exposure times and a reduction in PSI (i.e., thermal-work strain) of about 40% (FIG. 8B), 35% (FIG. 9B), and 25% (FIG. 10B), respectively.

Tests were conducted with a stationary sweating thermal manikin wearing a commercially available chemical protection suit (Blauer Multi-threat Ensemble, Blauer Manufacturing Company, Boston, Mass. 02215). The chemical protection suit was modified for water distribution on its outer surface. The modification included a thin wicking fabric bib and related tubing to distribute water over chest, abdomen and groin areas. The wicking bib system provided an evaporating water surface over about 27% of the suit area. In a climate chamber environment of 95° F. and 40% RH, the wicking bib system increased cooling by 119 watts, compared to cooling without the bib. With 80% of the suit wet, the potential cooling increase is estimated to be about 340 watts. The manikin tests further demonstrate the cooling capability of the two-stage evaporative cooling apparatus and method.

The simulation results of FIGS. 8B, 9B, and 10B and the manikin test results indicate that, at least for the test conditions, the ACP2E garment enables unlimited safe exposure times, compared to safe exposure times of about 180 minutes (FIG. 8A), 130 minutes (FIG. 9A), and 110 minutes (FIG. 10A) for the MOPP-4 ensemble.

It will be understood that many additional changes in the details, materials, steps and arrangement of parts, which have been herein described and illustrated in order to explain the nature of the invention, may be made by those skilled in the art within the principle and scope of the invention, as expressed in the appended claims.

What is claimed is:

1. A protective garment for an animate being, comprising:
an impermeable inner layer;
a reservoir disposed interior to the inner layer, for collecting sweat from the animate being;
an external reservoir disposed exterior to the inner layer for containing water, the external reservoir being fluidly connecter to the reservoir; and
a pump for moving the sweat from the reservoir to a location external to the inner layer.

2. The garment of claim 1, wherein the animate being is a human.

3. The garment of claim 2, wherein the reservoir comprises a gutter connected to the inner layer.

4. The garment of claim 3, wherein the pump is adapted to be disposed on a torso of the human.

5. The garment of claim 3, wherein the gutter is disposed circumferentially on the inner layer of a torso portion of the garment.

6. The garment of claim 3, wherein the pump is adapted to be disposed at an elbow joint of the human.

7. The garment of claim 6, wherein the gutter is disposed circumferentially on an inner layer of a sleeve portion of the garment.

8. The garment of claim 3, wherein the gutter is flexible.

9. The garment of claim 2, wherein the pump and reservoir are disposed in a boot of the garment.

10. The garment of claim 1, wherein the sweat collected in the reservoir comprises at least one of 1) unevaporated liquid sweat, and 2) liquid sweat that has exuded from the animate being, evaporated, and condensed on the inner layer.

11. The garment of claim 1, wherein the pump is disposed interior to the inner layer.

12. The garment of claim 1, further comprising a plurality of reservoirs disposed inside the inner layer, for collecting sweat from the animate being; and a plurality of pumps for moving the sweat from the reservoirs to locations external to the inner layer.

13. The garment of claim 1, further comprising a distribution system located external to the inner layer, for distributing the sweat on an exterior of the garment.

14. The garment of claim 6, further comprising an inlet tubing having one end in fluid communication with the reservoir and another end connected to an inlet of the pump.

15. The garment of claim 7, further comprising an outlet tubing having one end connected to an outlet of the pump and another end that passes through the inner layer.

16. The garment of claim 15, wherein the distribution system comprises at least one fluid conduit in fluid communication with the outlet tubing, and wicking material adjacent to the at least one fluid conduit.

17. The garment of claim 15, wherein the outlet tubing is operatively connected to the distribution system.

18. The garment of claim 13, wherein the distribution system comprises wicking material.

19. The garment of claim 18, wherein the wicking material is an external layer of the garment.

20. The garment of claim 13, wherein the distribution system comprises at least one fluid conduit.

21. The garment of claim 1, further comprising a) tubing that connects the external reservoir to the reservoir and b) water disposed in the external reservoir for transfer to the reservoir wherein the pump pumps the sweat and the water.

22. The garment of claim 21, further comprising outlet tubing having one end connected to the pump, the outlet tubing including at least one fluid exit port disposed interior to the inner layer for distributing at least one of sweat and water interior of the garment between the inner layer and the animate being.

23. A method, comprising:
placing the garment of claim 1 on an animate being;
collecting sweat from the animate being in the reservoir; and
pumping the sweat to an exterior of the inner layer.

24. The method of claim 23, wherein the sweat comprises sweat that has condensed on the inner layer.

25. The method of claim 23, wherein the sweat comprises unevaporated sweat.

26. The method of claim 23, further comprising, after pumping, distributing the sweat on an exterior of the garment.

27. The method of claim 26, further comprising, after distributing, evaporating the sweat from the exterior of the garment.

28. A method, comprising:

placing the garment of claim 2 on a human;

collecting sweat from the human in the reservoir, the sweat comprising at least one of 1) sweat that has condensed on the inner layer, and 2) unevaporated sweat;

pumping the sweat to an exterior of the inner layer; and after pumping, distributing the sweat on an exterior of the garment.

29. The method of claim 28, further comprising, after distributing, evaporating the sweat from the exterior of the garment.

30. A method, comprising:

placing the garment of claim 21 on an animated being;

collecting in the reservoir at least one of (a) the sweat from the animate being and (b) the water from the external reservoir; and pumping at least one of the sweat and the water to at least one of (a) an exterior of the inner layer and (b) an interior of the inner layer between the garment and the animate being.

31. The method of claim 30, wherein pumping to the interior of the inner layer includes distributing at least one of the sweat and the water between the inner layer and the animate being.

* * * * *